US006547434B1

(12) United States Patent
DeRosa

(10) Patent No.: US 6,547,434 B1
(45) Date of Patent: Apr. 15, 2003

(54) SET STARTER TIMING DEVICE

(76) Inventor: Eric DeRosa, 102 Canterstone Ct., Raleigh, NC (US) 27606

( * ) Notice: Subject to any disclaimer, the term of this patent is extended or adjusted under 35 U.S.C. 154(b) by 0 days.

(21) Appl. No.: 09/226,487

(22) Filed: Jan. 7, 1999

Related U.S. Application Data

(60) Provisional application No. 60/071,131, filed on Jan. 12, 1998.

(51) Int. Cl.[7] ..... G04C 17/00; G04F 1/00

(52) U.S. Cl. ..... 368/89; 368/279; 368/263; 368/244; 368/276

(58) Field of Search ..... 368/89, 96, 98, 368/107–109, 230, 244, 262, 263, 279; 273/445, 69; 63/1.13, 15, 22; 340/815.69, 309.15, 323 R

(56) References Cited

U.S. PATENT DOCUMENTS

| | | | | |
|---|---|---|---|---|
| 1,494,104 A | | 5/1924 | Dinhofer | |
| 2,066,437 A | | 1/1937 | Vitrone | |
| 3,822,547 A | * | 7/1974 | Fujita | 368/109 |
| 4,035,793 A | | 7/1977 | Jennings | 340/309 |
| 4,117,662 A | | 10/1978 | van der Lely | 58/50 |
| 4,163,360 A | * | 8/1979 | Tanaka et al. | 368/98 |
| 4,218,871 A | * | 8/1980 | Moritani et al. | 368/109 |
| 4,451,158 A | | 5/1984 | Selwyn et al. | 368/107 |
| 4,472,065 A | * | 9/1984 | Goodman | 368/230 |
| 4,632,570 A | * | 12/1986 | Kelsey | 368/107 |
| 4,995,018 A | * | 2/1991 | Edwards | 368/107 |
| 5,058,086 A | | 10/1991 | Barlow | 368/98 |
| 5,077,708 A | | 12/1991 | Schneider | |
| 5,088,072 A | | 2/1992 | Fitzmorris | 368/69 |
| 5,181,009 A | * | 1/1993 | Perona | 368/108 |
| 5,224,700 A | | 7/1993 | Rosen | 273/32 |
| 5,559,495 A | * | 9/1996 | Cochran | 368/109 |
| 5,894,271 A | * | 4/1999 | Cleveland et al. | 368/109 |

FOREIGN PATENT DOCUMENTS

| | | | |
|---|---|---|---|
| GB | 2043966 | * 10/1980 | 368/107 |

* cited by examiner

*Primary Examiner*—Vit Miska
*Assistant Examiner*—Jeanne-Marguerite Goodwin
(74) *Attorney, Agent, or Firm*—Mills Law Firm, PLLC

(57) ABSTRACT

A timing device for use in athletic workouts which measures the passage of short intervals of time such as the recovery periods between successive sets of exercise is disclosed. The present timing device is contained in a housing which may be worn on an elastic band about a user's thumb and actuated by a single finger on the same hand. In one embodiment the timing device includes a sliding interval selector switch that enables the user to select preset time intervals of fifteen, thirty, forty-five, and sixty seconds. The interval selector switch actuates a count-down timer which transmits a signal to a miniature speaker to produce an audible alarm, or in the alternative, to a vibratory device advantageous to visually or hearing impaired users. In an alternative embodiment the timing device includes a micro-processor having memory and computing functions which permit desired time intervals to be programmed by the user.

10 Claims, 4 Drawing Sheets

SET STARTER TIMING DEVICE

CROSS-REFERENCE TO RELATED APPLICATION

This Application claims the benefit under 35 U.S.C. 119 (e) of U.S. Provisional Application No. 60/071,131 filed Jan. 12, 1998, by Eric DeRosa for Set Starter.

BACKGROUND OF INVENTION

1. Field of Invention

This invention relates to timing devices and, more particularly, to a monitoring device for use in athletic workouts which indicates the passage of a preselected time interval to accurately measure recovery time.

Timing devices for measuring performance in various athletic events such as track and field, swimming, bicycling etc. are well known to those skilled in the art. Traditionally the timing device has been in the form of a stop watch or other similar timer which is started at the beginning of the event and stopped at the finish to measure the total elapsed time.

Although such stop watch devices may be convenient for coaches and trainers of athletes, they are difficult for the athlete to carry during a training activity because they are cumbersome and detract from the athlete's performance.

Various wristwatches and other wrist mounted timers include a digital stop watch having an audible alarm which can be set to preselected time intervals. However, such devices also tend to impede performance by distracting the athlete.

Although such prior art timing devices have proven to be useful in measuring the duration of athletic events, there is a need for an athletic monitoring device which is capable of giving an indication of passage of short intervals of time such as the recovery periods between successive sets of physical exercise as would be common to weight training, physical therapy sessions and calisthenics with design and operation features that would not hinder activity. By accurately measuring recovery time, the effectiveness of the workout is maximized and desired results more easily achieved.

2. Description of Related Prior Art

U.S. Pat. No. 5,088,072 to Bernard Fitzmorris discloses an athletic performance measuring device which can be conveniently worn on the user's finger. This device can provide a variety of functions such as lap counting and timing. An actuator is provided in the form of a thumb switch to allow the counter/timer to be held and operated by one hand without disrupting the athlete's performance. However, this timing device does not disclose the present method of timing rest intervals between sets of exercise nor does it provide a vibratory alarm to the user so as to be operated non visually.

U.S. Pat. No. 5,058,086 to Gordon A. Barlow discloses a recreational timing apparatus for giving an indication of the passage of a preselected time interval and which gives a visual indication of the end of the preselected time interval. This timing apparatus while capable of being used in other environments is particularly adaptable as part of a board game in which a players turn must occur before a preselected time interval has expired. However, this device is not designed to be worn on one's person nor does it provide a vibrating alarm.

U.S. Pat. No. 4,035,793 to Vincent M. Jennings discloses a signaling interval timer including a hollow unitary housing having a peripheral slot formed therein. A sealed flexible elongated bag filled with a viscous liquid is affixed within the housing adjacent to the slot. A spiral coil spring is mounted within the housing and is provided at its outer end with an arm adapted to move along a predetermined path across a surface of the elongated back. Pressure regulating means are provided for varying pressure which the arm exerts upon the elongated bag. Signal means are provided for generating an audible signal when the arm moves to a predetermined position along the path. However, this interval timer is limited to measuring intervals of one-half hour to one hour in duration.

U.S. Pat. No. 4,451,158 to Stephen Selwyn, et al discloses a count down time designed for counting down predetermined intervals of time and periodically announcing the progressive laps of the count down period through the use of a voice synthesizer. The time interval between the spoken announcements is decreased as the end of the period approaches. This timer is ideally suited for use by yachtsmen and others who require both visual and audible signals representing the laps of a predetermined time period. However, this device is not intended to be carried on one's person during athletic exercise nor does it provide a vibratory alarm signal.

U.S. Pat. No. 4,117,662 to Cornelis van der Lely discloses wrist and ring mounted watches having a display face and an actuation mechanism to illuminate the display face. In the case of the ring watch the actuation mechanism is a knob on the side of the case or of the ring so that it can be actuated by an adjacent finger. However, this ring watch does not disclose a timing mechanism for short intervals or a vibratory alarm signal in the manner of the present invention.

U.S. Pat. No. 2,066,437 to Joseph Vitrone discloses a ring watch wherein the watch is hingedly mounted on the ring and is provided with an enclosure which prevents the watch crown from catching on articles such as clothing. However, this ring watch does not disclose a timing device for short intervals nor does it include an alarm of any type.

U.S. Pat. No. 1,494,104 to Julius Dinhofer discloses a ring watch which is small and compact in construction resembling a finger ring in every respect. However, this patent does not disclose a short interval timing device nor does it disclose an alarm capability.

U.S. Pat. No. 5,224,700 to Carl-Erik M. Rosen discloses a combined putting green repair tool and stop watch which is used for repair pitch-marks made on greens when playing golf and is also provided with a timing device which allows specific time periods applicable to the game of golf to be measured. Although this timing device is provided with an audible or visual alarm signal, it is not provided with a vibratory alarm signal nor is it designed to be worn on the wrist or finger, but rather carried in the golfer's pocket.

Finally, U.S. Pat. No. 5,077,708 to Ernest Schneider discloses a stop-watch wristwatch comprising a stop-watch hand which completes one revolution per minute and a minute-counting down device comprising a graduated dial on which is mounted a rotating disk sector completing a fraction of a revolution per minute, so that at the start of counting-down, the disk sector reveals a contrasted dial sector preceding the zero of the graduated scale, the width of this sector diminishing as counting-down proceeds. However, this patent discloses only a visual indicator to the user and does not disclose the use of both auditory and vibratory alarm signals.

SUMMARY OF THE INVENTION

Recent studies relating to physical fitness and, in particular, weight training have shown that the period of time which elapses between successive sets of exercise is critical to building muscle tissue and strength.

As a general rule, the more time that elapses between sets in weight training, for example, the less effective the exercise. Fitness experts have demonstrated that the body recovers approximately 72% of its strength within a minute after intense exercise. Within three minutes the body recovers all the strength it's going to recover without an extended rest period. Monitoring an athlete's recovery time is essential to achieving optimum desired results.

To build strength the athlete must stimulate and fatigue the maximum number of muscle fibers. With each subsequent set, the muscles become more fatigued and the body utilizes additional muscle fibers to pick up the slack. Hence, the experts recommend that the rest periods or breaks between sets of exercises be kept to a minute or less in duration. By doing so you will push your muscles and effectively maximize the exercise.

Accordingly, the timing device or Set Starter™ of the present invention has been developed to indicate to the athlete the passage of a preselected time interval or recovery time between sets of exercise. The present timing device is of particular advantage to visually and/or hearing impaired athletes in that it provides an optional vibratory alarm signal after the passage of a preselected time interval.

In view of the above it is an object of the present invention to provide a timing device which will alert the athlete to the passage of a preselected time interval of one minute or less to maximize the workout.

Another object of the present invention is to provide a timing device which can be worn by the athlete on the thumb or finger of either hand and which provides a switch that is actuated by a single finger.

Another object of the present invention is to provide a timing device which provides both an auditory and a vibratory alarm to indicate the passage of a preselected time interval which is particularly advantageous to the visually or hearing impaired.

Another object of the present invention is to provide a timing device that is not cumbersome to the user and that can be worn without hindering activity.

Another object of the present invention is to provide a timing device that is conveniently operated non-visually.

Other objects and advantages of the present invention will become apparent and obvious from a study of the. following description and the accompanying drawings which are merely illustrative of such invention.

DETAILED DESCRIPTION OF THE PREFERRED EMBODIMENT

Figure 1:
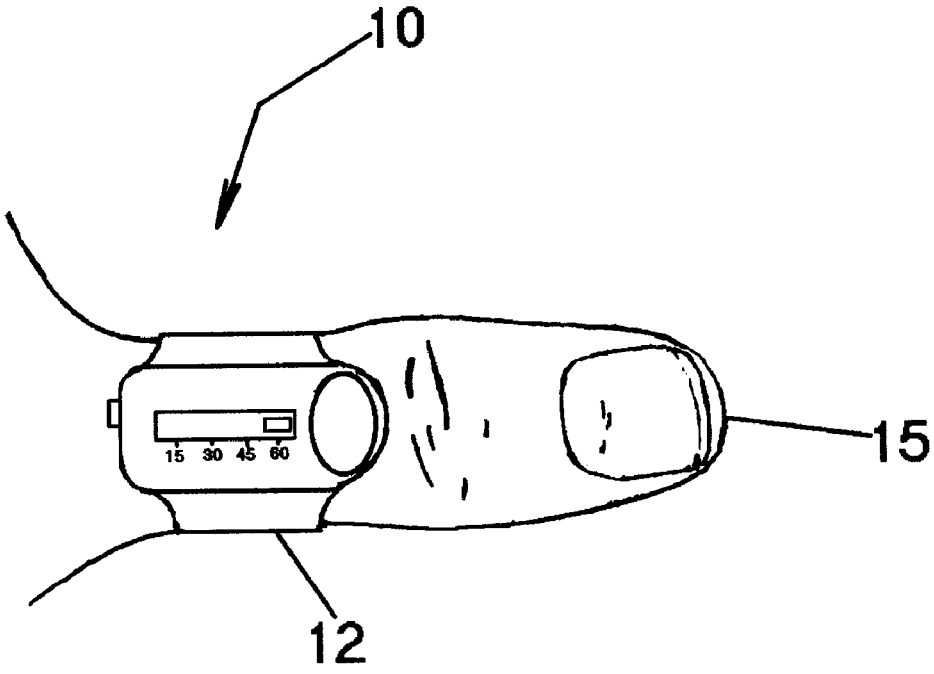
FIG. 1 is a perspective view showing the timing device of the present invention being worn on a user's thumb.

With reference to the drawings, there is shown therein a timing device in accordance with the present invention, indicated generally at 10 and illustrated in FIG. 1.

In the preferred embodiment the timing device 18 is to be mounted on one of the user's fingers, and preferably the user's thumb between the first and second joints thereof as shown in FIG. 1.

The timing device 10 includes an elastic band portion 12 fabricated from rubber or any suitable elastic material for securing the timing device about the user's thumb 15 or another finger. The elastic band 12 is beneficial in that it can be utilized to accommodate a variety of finger and thumb sizes. In the alternative, the band 12 includes mating strips of a hook and loop type fastener (not illustrated) such as that sold under the trade name VELCRO.

Since such hook and loop type fasteners are well known to those skilled in the art, further detailed discussion of the same is not deemed necessary.

Figure 2:
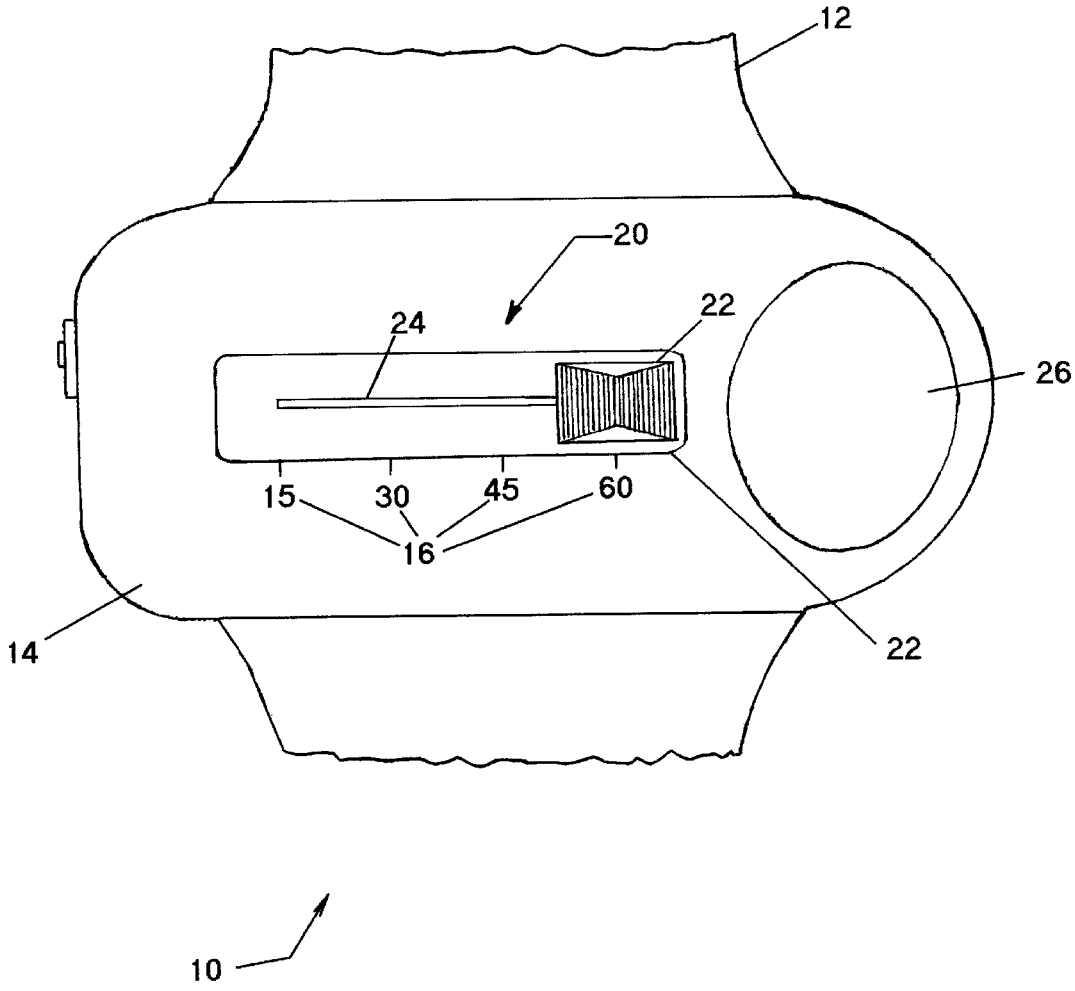
FIG. 2 is an enlarged perspective view of the present timing device showing the housing and operating controls.

Referring now to FIG. 2, the timing device 10 includes a housing 14 which can be detached from the elastic band 12 such that a backing plate (not shown) can be removed for the replacement of batteries 15 contained therein. The backing plate forms a water tight seal to prevent damage to the electrical circuitry contained therein. The timing device 10 utilizes a commercially available miniature battery having sufficient capacity to provide the timing functions of the present invention.

Since such miniature batteries are well known to those skilled in the art, further detailed discussion of the same is not deemed necessary.

The upwardly facing portion of the housing 14 is provided with a time selector display, indicated generally at 20, having numeric indicia 16 imprinted thereon corresponding to preselected time intervals in seconds. In the preferred embodiment the numeric indicia 16 are raised numerals or raised dots (not shown) of the Braille alphabet for the convenience of a visually impaired user.

The display 20 includes a time selector switch 22 which is adapted for sliding movement within a slot 24 formed in the housing 14. In normal use the switch 22 is advanced within the slot 24 to the desired time interval represented by indicia 16. In this manner, the switch 22 mechanically engages a plurality of electrical contacts to close a particular circuit within a digital counter 25 contained in the housing 14 as described hereinafter in further detail.

Because such digital counters are in a practical state of development as a separate component, further detailed discussion of the same is not deemed necessary.

An activator switch 26 projects slightly from the housing 14 to permit the timing functions of the device to be actuated by a user's index finger by depressing the same. The activator switch 26 is constructed to provide a mechanical click that can be felt by the user to indicate that the timing function has been activated and that the selected interval has commenced.

Figure 3:
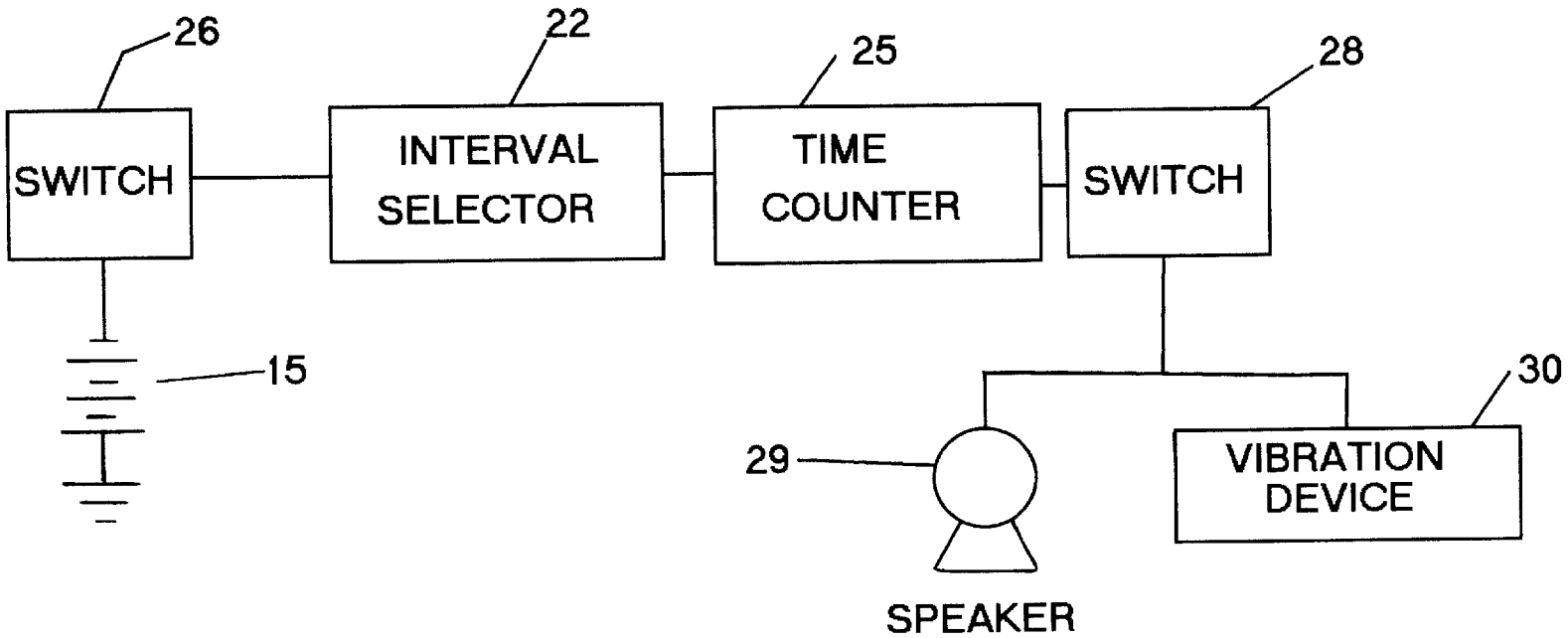
FIG. 3 is a schematic view of the circuitry and components of the present timing device.
Figure 4:
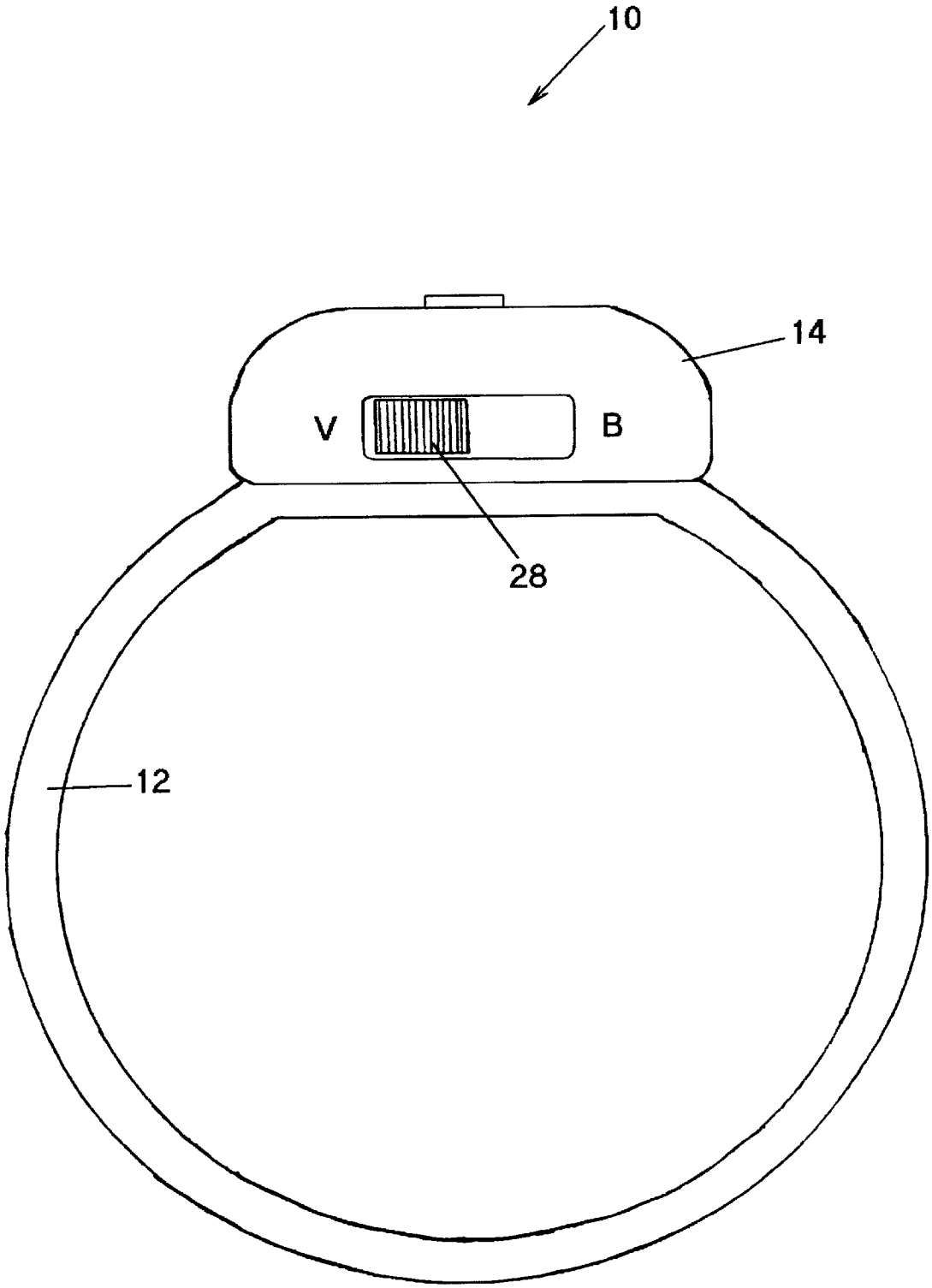
FIG. 4 is a side elevational view of the present timing device showing the selector switch for the audible/vibratory alarm.

Referring now to FIG. 3 there is shown therein a schematic representation of the circuitry for carrying out the functions of the timing device 10. In the basic form of the present invention upon each activation of the switch 26 with the time selector switch 22 set for the desired time interval, the counter 25 counts upward until it receives an input signal from the interval selector at which time it resets. At this time current flows from the battery through the beep/vibrate selector switch 28 as shown in FIG. 4.

The non-visual operation of the present invention is important primarily for convenience and accuracy. For example, an athlete who does three sets of 12 exercises will need to rest 35 times. Currently there are three common ways of measuring recovery time between sets: (1) guessing at the elapsed time which is extremely inaccurate and compromises results; (2) wearing a watch which is cumbersome and requires constant eye contact and concentrated effort; and (3) watching a clock on the wall which also requires constant eye contact and which is not always visible when traveling from exercise to exercise station. The present invention solves this problem with convenient and accurate monitoring of the time interval between sets of exercises.

With the push of a button, the timing device 10 is capable of indicating to a user that the preselected a time interval has elapsed in either auditory or vibratory mode. In the auditory mode the current flows through the switch 28 to activate a miniature speaker 29. Any number of commercially available speakers 29 of the type used in wristwatches to provide an alarm are suitable for this purpose.

In the alternative, current flows to the vibration device 30 which provides a tactile stimulus to the user indicating that the time interval has elapsed.

The vibration device 30 is particularly advantageous to visually or hearing impaired users of the present device who would otherwise be unable to use it.

Since such vibrating devices are well known to those skilled in the art as a separate component, further detailed discussion of the same is not deemed necessary.

In an alternative embodiment (not illustrated) of the present device, the timing device 10 includes a microprocessor having memory and computing functions such that the time intervals can be programmed by the user as desired. In this version the timing device includes an LCD screen (not shown) for the display of counting and timing information.

In this embodiment the device 10 is programmable to count and display elapsed time or time remaining in one second intervals at the user's discretion.

Since such micro-processors and LCD screens are in a practical state of development, further detailed discussion of the same is not deemed necessary.

The timing device 10 is provided with a carrying case (not shown) which may be carried in the user's pocket or workout bag to protect the device when not in use. Further, the carrying case may include a strap or chain to be worn about the uset's neck if desired.

From the above it can be seen that the timing device or set starter of the present invention provides a timing device which can be utilized to measure the recovery time between successive sets of physical exercises to maximize the effectiveness of a user's workout.

The timing device provides an indication to the athlete that the preselected time interval between sets has elapsed in the both an auditory and vibratory mode.

The non-visual operation of the present invention offers the user both convenience and accuracy.

The design of the present invention is not cumbersome to the user and is operable without hindering activity.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A method of controlling short interval rest periods between successive sets of athletic exercises performed by a user, comprising the steps of:

(a) providing a timing device carried on the top surface of a thumb of the user having a switch member on a top front surface proximate the nail of the thumb and engagable by the adjacent index finger of the user, said timing device having time counting means for establishing time interval of about one minute or less initiated by actuating said switch member and concluded with an alarm, said time counting means having selector means slidably carried on said top surface for setting by said index finger of said user for setting said time interval;

(b) attaching said timing device on said thumb of said user and setting said time interval;

(c) having said user perform an athletic exercise;

(d) actuating said switch to commence said time interval after completion of said athletic exercise;

(e) subsequent to said alarm having the user repeat steps (c) and (d) until completion of said sets of athletic exercise.

2. The method of controlling rest periods as recited in claim 1, including providing indicia on said top surface of said timing means adjacent said controller for indicating equal spacing of said time intervals.

3. The method of controlling rest periods as recited in claim 2 wherein said time intervals are 15 second increments.

4. The method as recited in claim 3 wherein said indicia indicate 15, 30 45 and 60 second increments.

5. The method as recited in claim 4 including providing an elastic band for compressively attaching said timing means to said thumb of the user.

6. The method as recited in claim 1 including providing plural user V selected modes for indicating said alarm.

7. The method as recited in claim 6 including providing a user operable switch at the rear of said timing means for selecting said modes.

8. The method as recited in claim 7 wherein said audible modes are selected from vibratory and audible modes.

9. A short interval timing device for measuring rest periods between successive sets of athletic exercises, said timing device comprising:

housing means for extending along a thumb of a user and having a bottom surface engagable with the top surface of the thumb of the user;

elastic attaching means connected at the sides of said housing means for attaching said housing means at said top surface of and between the second and third joints of said thumb of said user;

time counting means carried by said housing means for serially counting elapsed times;

an actuator button on said housing at a top front surface of said housing means proximate said nail of said thumb, said button being depressible for activating said time counting means for serially counting said elapsed times, said actuator button being disposed so as to be activated by the adjacent index finger of said user and providing tactile feedback to the user upon activation;

interval selecting means operatively associated with said time counting means for establishing a user selected preset short time interval of around about one minute or less based on counting said elapsed times, said interval selecting means including a time selector switch slidably mounted in a longitudinal slot formed in said top surface of said housing means for sliding movement by said index finger of said user to establish said preset time interval;

non-visual indicating means operatively associated with said interval selecting means for providing the sole alert to said user at expiration of said preset time interval said indicating means providing an audible alert mode and a vibratory alert mode, said indicating means including selector means carried at said rear of said housing means for actuation by said user to select one of said modes; and longitudinally spaced numeric indicia formed on said housing means adjacent said slot for visibly correlating said present time interval.

10. The timing device as recited in claim 9 wherein said indicia means are linearly displayed in raised numeric form on said housing means and said interval selecting means includes a linearly slidable controller spatially referenced to said indicia means for establishing said preset time interval.

* * * * *